US012663248B2

(12) United States Patent
Xu et al.

(10) Patent No.: US 12,663,248 B2
(45) Date of Patent: Jun. 23, 2026

(54) METHOD FOR EVALUATING DEEP-BURIED TUNNEL BLASTING PARAMETERS

(71) Applicant: Sichuan University, Chengdu (CN)

(72) Inventors: Nuwen Xu, Chengdu (CN); Biao Li, Chengdu (CN); Quanfu Ding, Chengdu (CN); Haoyu Mao, Chengdu (CN); Peiwei Xiao, Chengdu (CN); Xiang Zhou, Chengdu (CN); Xinchao Ding, Chengdu (CN); Yuepeng Sun, Chengdu (CN); Yong Xia, Chengdu (CN); Jun Liu, Chengdu (CN); Zhiqiang Sun, Chengdu (CN)

(73) Assignee: Sichuan University, Chengdu (CN)

( * ) Notice: Subject to any disclaimer, the term of this patent is extended or adjusted under 35 U.S.C. 154(b) by 344 days.

(21) Appl. No.: 18/242,028

(22) Filed: Sep. 5, 2023

(65) Prior Publication Data

US 2024/0102782 A1 Mar. 28, 2024

(30) Foreign Application Priority Data

Sep. 5, 2022 (CN) ..... 202211075467.3

(51) Int. Cl.
*F42D 5/00* (2006.01)
*E21D 9/00* (2006.01)
*F42D 3/04* (2006.01)

(52) U.S. Cl.
CPC ..... *F42D 5/00* (2013.01); *E21D 9/006* (2013.01); *F42D 3/04* (2013.01)

(58) Field of Classification Search
CPC ... F42D 5/00; F42D 3/04; E21D 9/006; G06F 30/20; G01B 11/00; G01B 17/02; G01H 17/00; G06T 17/05
See application file for complete search history.

(56) References Cited

U.S. PATENT DOCUMENTS 6,460,462 B1 * 10/2002 Rosenstock ..... G01V 1/108 102/302
11,976,914 B1 * 5/2024 Yang ..... F42D 1/22
12,111,145 B2 * 10/2024 Jeong ..... B64U 20/00
2017/0356730 A1 * 12/2017 Wang ..... F42D 1/22
2020/0250355 A1 * 8/2020 Giltner ..... G06Q 50/02
2021/0310349 A1 * 10/2021 Loveland ..... G01F 17/00

* cited by examiner

*Primary Examiner* — Francis C Gray
(74) *Attorney, Agent, or Firm* — HOUTTEMAN LAW LLC

(57) ABSTRACT

The invention provides a method for evaluating deep-buried tunnel blasting parameters, and belongs to the technical field of mine engineering. The method comprises: setting multiple diverse blasting schemes; selecting a plurality of test sections with the same geological characteristics, the number of the test sections corresponding to the number of the blasting schemes; blasting the test sections using the blasting schemes, and obtaining diversified monitoring data of each test section; and comparing the diversified monitoring data to select the optimal blasting schemes for the test sections. According to the method for evaluating the deep-buried tunnel blasting parameters, by implementing different blasting schemes in test sections with the same geological characteristics, diversified monitoring data of the test sections are obtained and compared to select the optimal blasting schemes for the test sections, so as to ensure the safety and quality of blasting excavation of deep-buried tunnels.

9 Claims, 19 Drawing Sheets drilling and blasting parameter list

| blasthole type | hole depth cm | hole diameter cm | number | hole spacing cm | resistance line cm | explosive diameter cm | additional hole charge kg | Remarks |
|---|---|---|---|---|---|---|---|---|
| inner cut hole | 600 | 48 | 20 | 80 | | 32 | 2.80 | |
| outer cut hole | 600 | 48 | 34 | 80 | | 32 | 2.30 | |
| breaking hole | 400 | 48 | 88 | 80 | 80-90 | 32 | 1.80 | |
| bottom hole | 400 | 48 | 18 | 80 | 90 | 32 | 1.80 | |
| peripheral hole | 400 | 48 | 49 | 50 | 90 | 32 | 0.45-0.60 | |

Notes: 1. Emulsion explosive used; 2. Blasting parameters are adjusted according to the field test in the construction process main technical indexes of blasting design

| excavated section $m^2$ | total number of blastholes | density of blastholes $/m^2$ | expected footage $d$ per cycle of explosive | blasting efficiency % | blasting volume | total charge $m^3$ | unit explosive consumption kg/$m^3$ |
|---|---|---|---|---|---|---|---|
| 138.32 | 206 | 1.77 | 4.00 | 85-90 | 479.28 | 300 | 0.63 |

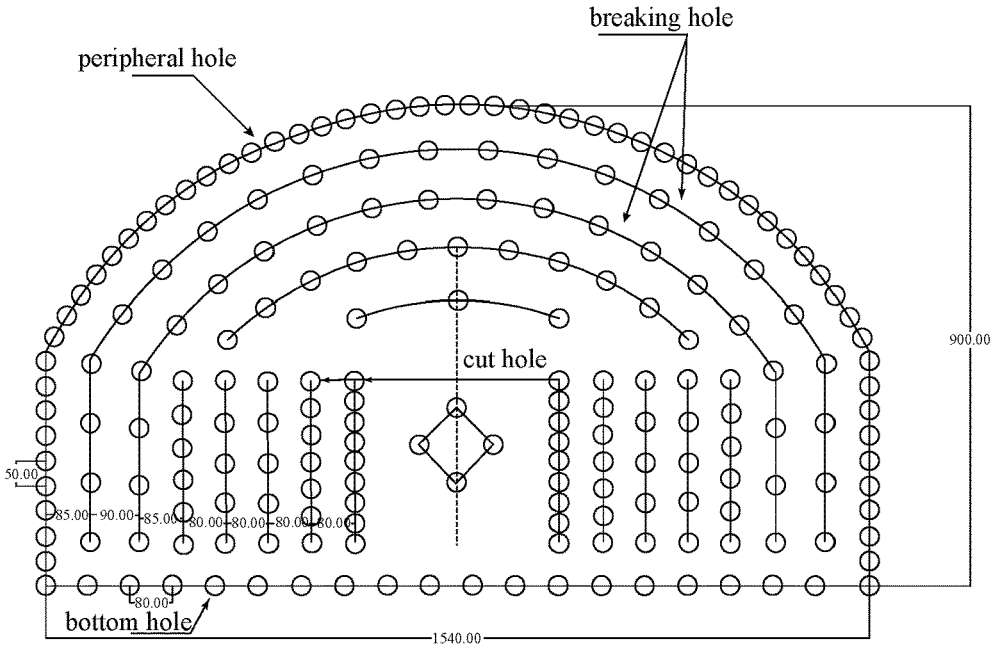

borehole layout plan drilling and blasting parameter list

| blas:hole type | hole depth cm | hole diameter cm | number | hole spacing cm | resistence line cm | explosive dameter cm | individual-hole charge kg | Remarks |
|---|---|---|---|---|---|---|---|---|
| inner cut hole | 600 | 48 | 20 | 80 | | 32 | 2.10 | |
| outer cut hole | 600 | 48 | 14 | 80 | | 32 | 2.10 | |
| breaking hole | 400 | 48 | 88 | 80 | 80~90 | 32 | 1.80 | |
| bottom hole | 400 | 48 | 18 | 80 | 90 | 32 | 1.80 | |
| peripheral hole | 400 | 48 | 60 | 50 | 90 | 32 | 0.45~0.60 | |
| Notes: 1. Emulsion explosive used; 2. Blasting parameters are adjusted according to the field test in the construction process | | | | | | | | |

main technical indexes of blasting design

| excavated section $m^2$ | total number of blastholes | density of blastholes /$m^2$ | expected footage m per row of explosive | blasting efficiency % | blasting volume | total charge $m^3$ | unit explosive consumption kg/$m^3$ |
|---|---|---|---|---|---|---|---|
| 118.32 | 200 | 1.77 | 4.00 | 85~90 | 473.28 | 300 | 0.63 |

FIG. 2

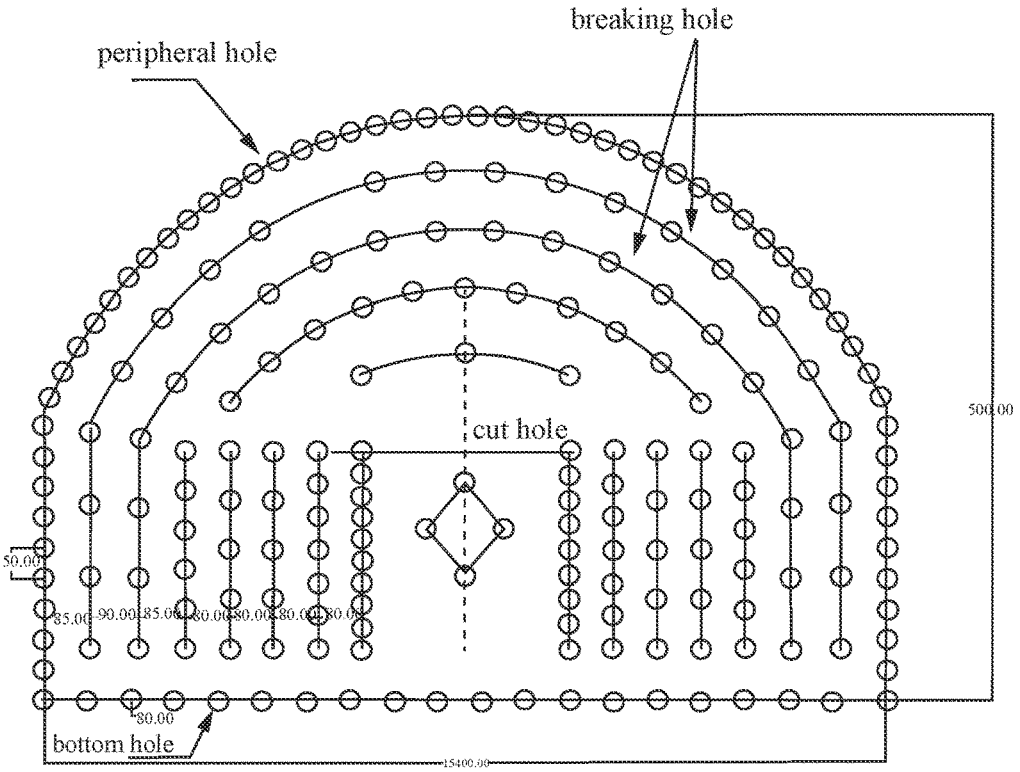

borehole layout plan drilling and blasting parameter list

| blasthole type | hole depth cm | hole diameter cm | number | hole spacing cm | resistance line cm | explosive diameter cm | individual-hole charge kg | Remarks |
|---|---|---|---|---|---|---|---|---|
| inner cut hole | 600 | 48 | 20 | 80 | | 32 | 2.40 | |
| outer cut hole | 600 | 48 | 14 | 80 | | 32 | 2.40 | |
| breaking hole | 400 | 48 | 88 | 80 | 80~90 | 32 | 2.10 | |
| bottom hole | 400 | 48 | 18 | 80 | 90 | 32 | 2.40 | |
| peripheral hole | 400 | 48 | 60 | 50 | 90 | 32 | 0.3~0.6 | |
| Notes:1.Emulsion explosive used:2.Blasting parameters are adjusted according to the field test in the construction process | | | | | | | | |

main technical indexes of blasting design

| excavated section $m^2$ | total number of blastholes | density of blastholes /$m^2$ | expected footage m per row of explosive | blasting efficiency % | blasting volume $m^3$ | total charge kg | unit explosive consumption kg/$m^3$ |
|---|---|---|---|---|---|---|---|
| 118.32 | 200 | 1.77 | 4.00 | 85~90 | 473.28 | 336.6 | 0.71 |

FIG. 3

| | vibration velocity at position(25) m away from heading face | vibration velocity at position(30) m away from heading face | vibration velocity at position(35) m away from heading face | vibration velocity at position(40) m away from heading face | vibration velocity at position(45) m away from heading face | k | a | distance from heading face whenvibration velocity is 15 cm/s |
|---|---|---|---|---|---|---|---|---|
| Test section A: blasting scheme A | 9.97 | 7.54 | 4.86 | 4.29 | 3.96 | 193.69 | 1.67 | 18.21 |
| | 7.62 | 5.54 | 4.15 | 3.25 | 2.63 | 199.36 | 1.82 | 17.68 |
| | 7.74 | 5.76 | 4.47 | 3.56 | 2.95 | 180.73 | 1.73 | 17.52 |
| | 7.97 | 5.74 | 4.34 | 3.41 | 2.74 | 224.90 | 1.85 | 17.82 |
| | 8.38 | 6.09 | 4.65 | 3.68 | 2.99 | 207.50 | 1.78 | 18.23 |
| | 7.80 | 5.62 | 4.26 | 3.35 | 2.71 | 211.50 | 1.83 | 17.61 |
| Test section B: blasting scheme B | 6.34 | 4.75 | 3.68 | 2.96 | 2.45 | 118.63 | 1.62 | 14.98 |
| | 7.32 | 5.49 | 4.28 | 3.46 | 2.88 | 126.82 | 1.59 | 15.96 |
| | 7.39 | 5.67 | 4.51 | 3.69 | 3.11 | 105.62 | 1.48 | 15.62 |
| | 7.14 | 5.38 | 4.22 | 3.43 | 2.86 | 112.46 | 1.54 | 15.36 |
| | 6.31 | 4.62 | 3.53 | 2.83 | 2.34 | 136.23 | 1.71 | 14.95 |
| | 6.00 | 3.09 | 2.61 | 2.53 | 2.07 | 94.86 | 1.63 | 12.95 |
| test section A1:average fittingblasting scheme A | 8.25 | 6.05 | 4.46 | 3.59 | 3.00 | 190.71 | 1.75 | 17.82 |
| test section B1:average fittingblasting scheme B | 6.69 | 4.88 | 3.70 | 2.93 | 2.40 | 114.72 | 1.59 | 14.82 |

FIG. 8 blasting scheme A blasting scheme B

| number | position | number of peripheral holes | unblasted hole number | unblasted hole rate |
|---|---|---|---|---|
| 1 | K0+388 ~ K0+390 | 60 | 43 | 71.7 |
| 2 | K0+390 ~ K0+394 | 60 | 43 | 71.7 |
| 3 | K0+394 ~ K0+398 | 60 | 45 | 75.0 |
| 4 | K0+398 ~ K0+402 | 60 | 45 | 75.0 |
| 5 | K0+402 ~ K0+406 | 60 | 47 | 78.3 |
| 6 | K0+406 ~ K0+410 | 60 | 49 | 81.7 |
| 7 | K0+410 ~ K0+414 | 60 | 49 | 81.7 |
| 8 | K0+414 ~ K0+417 | 60 | 48 | 80.0 |
| 9 | K0+417 ~ K0+420 | 60 | 49 | 81.7 |
| 10 | K0+420 ~ K0+423 | 60 | 49 | 81.7 |
| 11 | K0+423 ~ K0+426 | 60 | 50 | 83.3 |
| 12 | K0+426 ~ K0+430 | 60 | 49 | 81.7 |
| 13 | K0+430 ~ K0+433 | 60 | 51 | 85.0 |
| 14 | K0+433 ~ K0+436 | 60 | 49 | 81.7 |
| 15 | K0+436 ~ K0+440 | 60 | 50 | 83.3 |
| 16 | K0+440 ~ K0+443 | 60 | 50 | 83.3 |
| 17 | K0+443 ~ K0+446 | 60 | 49 | 81.7 |
| 18 | K0+446 ~ K0+450 | 60 | 50 | 83.3 |
| 19 | K0+450 ~ K0+453 | 60 | 51 | 85.0 |
| 20 | K0+453 ~ K0+456 | 60 | 53 | 88.3 |
| 21 | K0+456 ~ K0+459 | 60 | 52 | 86.7 |
| 22 | K0+459 ~ K0+463 | 60 | 53 | 88.3 |
| 23 | K0+463 ~ K0+467 | 60 | 52 | 86.7 |

average unblasted hole rate blasting scheme A
78.61% blasting scheme B
84.84%

FIG. 9 comparison of average wave velocities of test section $A_1$ and test section $B_1$
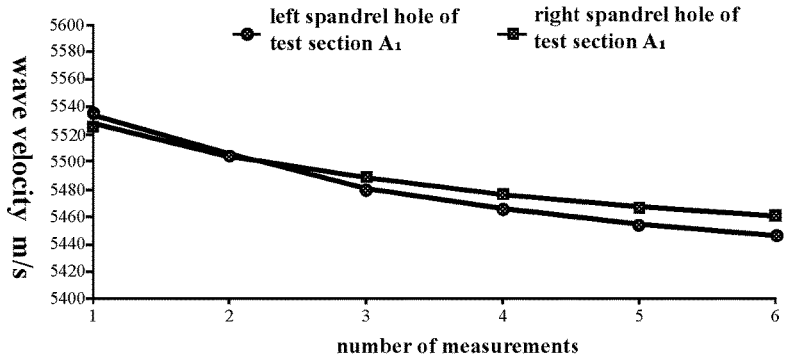
average wave velocity:
blasting scheme B > blasting scheme A
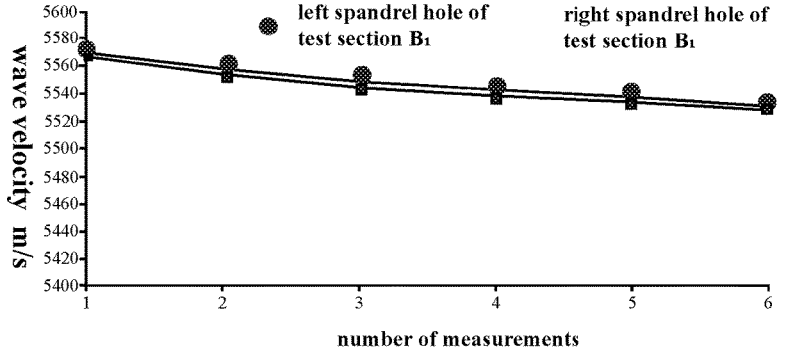
FIG. 12

| monitoring technology | evaluation indexes | blasting scheme A | blasting scheme B | optimal blasting scheme |
|---|---|---|---|---|
| blast vibration monitoring | vector resultant velocity | 9.97cm/s | 6.00cm/s | blasting scheme B |
| | risk distance | 17.82m | 14.82m | blasting scheme B |
| | average unblasted hole rate | 78.61% | 84.84% | blasting scheme B |
| broken rock zone | broken rock zone range | 0.6m | 0.6m | blasting scheme A/B |
| | average wave velocity of rock mass | 5532m/s~5455m/s | 5568m/s~5529m/s | blasting scheme B |
| three-dimensional laser scanning | average underbreak of typical fracture surfaces | -0.468 | -0.283 | blasting scheme B |

FIG. 19

METHOD FOR EVALUATING DEEP-BURIED TUNNEL BLASTING PARAMETERS

CROSS-REFERENCE TO RELATED PATENT APPLICATION

This application claims the benefit of priority to China Patent Application No. 202211075467.3, filed on Sep. 5, 2022. The entire content of the above identified application is incorporated herein by reference.

TECHNICAL FIELD

The invention relates to the technical field of mine engineering, in particular to a method for evaluating deep-buried tunnel blasting parameters.

BACKGROUND ART

With China's rapid economic growth and the global consensus on carbon peaking and carbon neutrality, mineral resources are set to play a pivotal role in the ongoing global energy transformation. However, due to mining disturbance on underground surrounding rock, the process of mining frequently gives rise to dynamic disasters, including large-scale inbreak and water inrush, resulting in significant losses to both human life and property. This issue becomes even more challenging in recent years as mining operations reach greater depths, subjecting protolith to heightened stress levels and leading to frequent and increasingly complex dynamic disasters in a deep rock mass. In order to ensure the safety of underground engineering projects such as mine roadways, transportation tunnels, and water tunnels, various geotechnical monitoring technologies have been introduced. These techniques encompass multipoint displacement meter monitoring, anchor stress gauge monitoring, geological radar prediction, blast vibration monitoring, microseismic monitoring, broken rock zone testing, and three-dimensional laser scanning. Each of these monitoring methods plays a crucial role in ensuring safety in their respective fields.

Safety monitoring focuses on in-process and post-process safety evaluations, which assess the rationality of support measures in the implementation process and after based on pre-determined numerical calculations. Blast monitoring focuses on protecting structures from damage and achieving excavation fragmentation. Most existing technologies lack the comprehensive application of diverse monitoring information for data analysis and safety evaluation, making it difficult to fully utilize on-site safety monitoring information.

Therefore, developing methods for evaluating deep-buried tunnel blasting parameters based on multi-dimensional monitoring information not only provides technical guidance for underground chamber construction safety, but also offers new ideas for selecting optimal blasting parameters through the comprehensive use of diverse monitoring information, promoting innovation and development in underground engineering construction technology.

SUMMARY OF THE INVENTION

The purpose of the invention is to provide a novel method for evaluating deep-buried tunnel blasting parameters. By implementing different blasting schemes in test sections with the same geological characteristics, diversified monitoring data of the test sections are obtained and compared to select the optimal blasting schemes for the test sections, so as to ensure the safety and quality of blasting excavation of deep-buried tunnels.

In order to achieve the above purpose, the invention adopts the following technical scheme.

According to an aspect of the invention, a novel method for evaluating deep-buried tunnel blasting parameters is provided. The method for evaluating the deep-buried tunnel blasting parameters comprises: setting multiple diverse blasting schemes; selecting a plurality of test sections with the same geological characteristics, the number of the test sections corresponding to the number of the blasting schemes; blasting the test sections using the blasting schemes, and obtaining diversified monitoring data of each test section; and comparing the diversified monitoring data to select the optimal blasting schemes for the test sections.

According to an implementation of the invention, the blasting scheme comprises individual-hole charge, total charge, blasthole arrangement, blasthole number and initiation mode.

According to an implementation of the invention, the individual holes comprise cut holes, breaking holes, bottom holes and peripheral holes.

According to an implementation of the invention, the length of the test section is 20-50 m, and when at least two consecutive test sections form a whole, the diversified monitoring data are obtained from a head section of each test section.

According to an implementation of the invention, obtaining diversified monitoring data of at least two test sections comprises: conducting blast vibration monitoring, broken rock zone monitoring, and three-dimensional laser scanning on the test sections; calculating a vector resultant velocity and a risk distance based on vibration monitoring data obtained from blast vibration monitoring; calculating an unblasted hole rate; calculating a rock wave velocity and a broken rock zone thickness based on acoustic wave test results of broken rock zone monitoring; and obtaining overbreak and underbreak situations of typical fracture surfaces based on 3D point cloud data obtained from three-dimensional laser scanning.

According to an implementation of the invention, calculating a vector resultant velocity and a risk distance based on vibration monitoring data obtained from blast vibration monitoring comprises: setting a safety allowable vibration velocity $v_0$; obtaining a terrain condition coefficient K and a geological condition coefficient $\alpha$; and substituting the safety allowable vibration velocity $v_0$ into the Sadaovsk formula $$R_0 = \left(\frac{K}{V_0}\right)^{\frac{1}{\alpha}} \cdot Q^{\frac{1}{3}}$$

to obtain a risk distance $R_0$, where Q is the total charge of simultaneous blasting or the maximum individual-stage charge of delayed blasting. According to an implementation of the invention, obtaining a terrain condition coefficient K and a geological condition coefficient $\alpha$ comprises: selecting a first monitoring point in the test section, installing a first sensor to monitor particle vibration velocities $v_{x1}$, $v_{y1}$, and $v_{z1}$ of the first monitoring point in x, y and z directions, and calculating a vector resultant velocity $v_1$ of the first monitoring point; measuring a distance $R_1$ from the first monitoring point to a heading face; selecting a second monitoring point in the test section, installing a second sensor to monitor particle vibration velocities $v_{x2}$, $v_{y2}$, and $v_{z2}$ of the second monitoring point in x, y and z directions, and calculating the vector resultant velocity $v_2$ of the second monitoring point; measuring a distance $R_2$ from the second monitoring point to the heading face; and substituting $v_1$ and $R_1$ into the Sadaovsk formula $$R_1 = \left(\frac{K}{V_1}\right)^{\frac{1}{\alpha}} \cdot Q^{\frac{1}{3}},$$

and substituting $v_2$ and $R_2$ into the Sadaovsk formula $$R_2 = \left(\frac{K}{V_2}\right)^{\frac{1}{\alpha}} \cdot Q^{\frac{1}{3}}$$

to form an equation set, so as to obtain the terrain condition coefficient K and the geological condition coefficient $\alpha$.

According to an implementation of the invention, there are five sensors, and the five sensors are sequentially arranged 25 m, 30 m, 35 m, 40 m and 45 m away from the heading face, so as to fit two curves according to the Sadaovsk formula to obtain the terrain condition coefficient K and the geological condition coefficient $\alpha$.

According to an implementation of the invention, calculating a rock wave velocity and a broken rock zone thickness based on acoustic wave test results of broken rock zone monitoring comprises: conducting rock wall drilling and water injection to provide a coupling agent needed for testing; sending a probe of an acoustic wave tester to a bottom of a hole, the probe comprising a transmitter and two receivers; adjusting parameters of the acoustic wave tester; continuously injecting water into the hole, and moving the probe along an axis of the hole according to a predetermined sampling interval to collect data separately, so as to obtain rock wave velocities at different depths from a surrounding rock wall; and plotting a depth-wave velocity curve according to the rock wave velocities, and obtaining the broken rock zone thickness.

According to an implementation of the invention, comparing the diversified monitoring data to select the optimal blasting schemes for the test sections comprises: comparing vector resultant velocities of at least two blasting schemes and selecting a blasting scheme with a smaller vector resultant velocity; comparing risk distances of at least two blasting schemes and selecting a blasting scheme with a smaller risk distance; comparing unblasted hole rates of at least two blasting schemes and selecting a blasting scheme with a larger unblasted hole rate; comparing broken rock zone thicknesses of at least two blasting schemes, and selecting a blasting scheme with a smaller broken rock zone thickness; comparing overbreak and underbreak situations of at least two blasting schemes, and selecting a blasting scheme with less overbreak and underbreak; and conducting comprehensive evaluation on the selected blasting schemes to determine the optimal blasting schemes for the test sections.

One embodiment of the invention has the following advantages or beneficial effects. According to the method for evaluating the deep-buried tunnel blasting parameters, blasting evaluation indexes are obtained through blast vibration monitoring, excavation face characteristics and 3D point cloud data fields are obtained through three-dimensional laser scanning, damage information of shallow and deep layers on a free face of a chamber is obtained through broken rock zone monitoring, and based on these core information, the quality of blasting excavation of deep-buried tunnels under different blasting schemes and the influence on an excavated chamber are evaluated from multiple dimensions, allowing for the selection of the optimal blasting schemes, and providing a new approach for evaluating various blasting schemes, thereby ensuring the safety and quality of blasting excavation of deep-buried tunnels.

BRIEF DESCRIPTION OF THE DRAWINGS

The above and other features and advantages of the invention will become more apparent by describing in detail exemplary implementations with reference to the accompanying drawings.

FIG. 2 is a drilling diagram of a blasting scheme A of a method for evaluating deep-buried tunnel blasting parameters according to an exemplary implementation.

FIG. 3 is drilling diagram of a blasting scheme B of a method for evaluating deep-buried tunnel blasting parameters according to an exemplary implementation.

FIG. 8 is a comparison diagram of averaged and fitted blast vibration data of a blasting scheme A and a blasting scheme B of a method for evaluating deep-buried tunnel blasting parameters according to an exemplary implementation.

FIG. 9 is a comparison diagram of unblasted hole rates of a blasting scheme A and a blasting scheme B of a method for evaluating deep-buried tunnel blasting parameters according to an exemplary implementation.

FIG. 12 is a comparison diagram of average wave velocities of a blasting scheme A and a blasting scheme B of a method for evaluating deep-buried tunnel blasting parameters according to an exemplary implementation.

FIG. 19 is a comparison diagram of diversified monitoring data of a blasting scheme A and a blasting scheme B of a method for evaluating deep-buried tunnel blasting parameters according to an exemplary implementation.

DETAILED DESCRIPTION OF THE INVENTION

Figure 1:
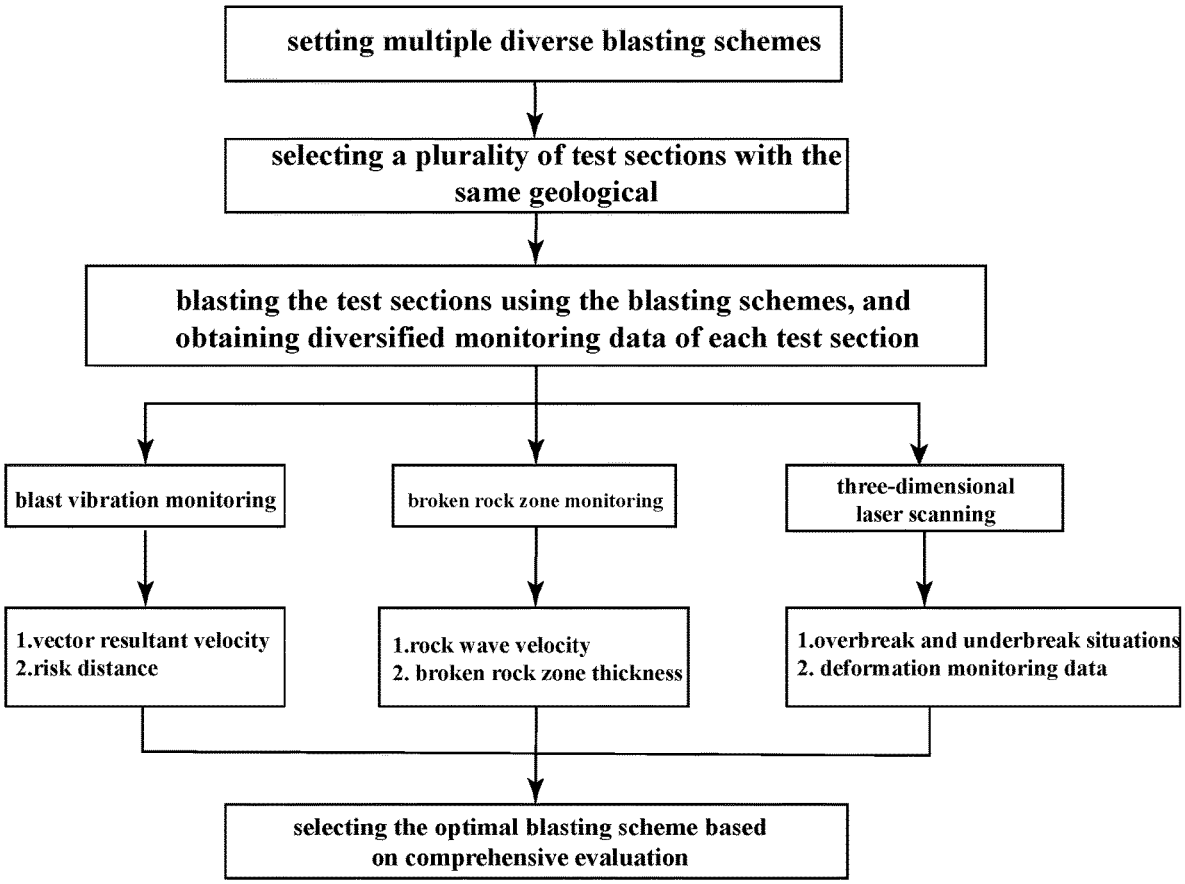
FIG. 1 is a flowchart of a method for evaluating deep-buried tunnel blasting parameters according to an exemplary implementation.

Exemplary implementations will be described more fully below with reference to the accompanying drawings. However, the exemplary implementations can be implemented in various forms and should not be construed as limited to the implementations set forth herein. These implementations are provided to make the invention more thorough and complete, and to fully convey the concept of the exemplary implementations to those skilled in the art. In the drawings, the same reference numerals refer to the same or similar structures, so detailed descriptions will be omitted.

The terms "one", "a", "the" and "said" are used to indicate the presence of one or more elements, components, etc. The terms "comprise" and "have" are used to indicate an open-ended inclusion, meaning that there may be other elements, components, etc. in addition to those listed.

Figure 4:
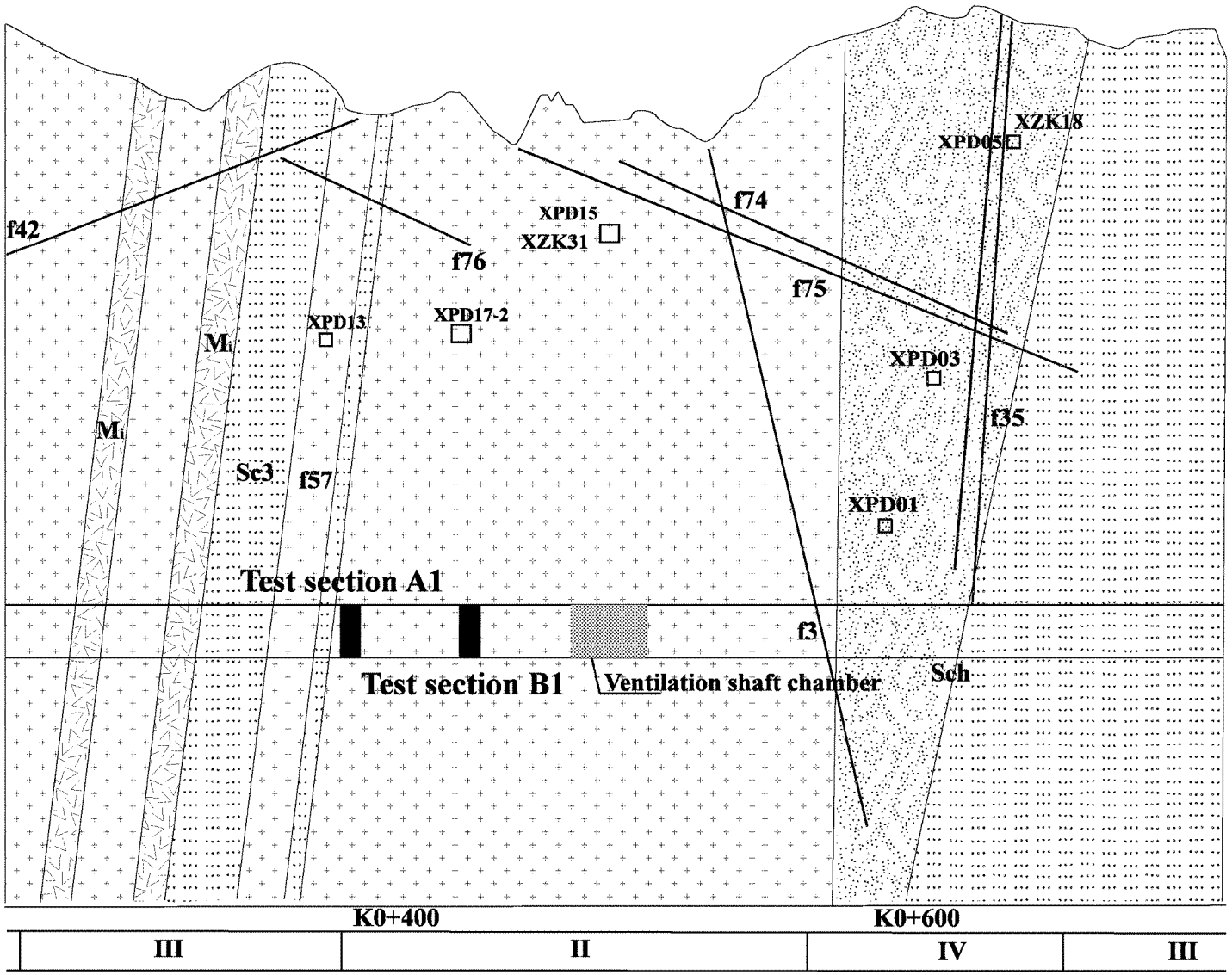
FIG. 4 is a vertical section view of geological conditions of a test section $A_1$ and a test section $B_1$ in a method for evaluating deep-buried tunnel blasting parameters according to an exemplary implementation.
Figure 5:
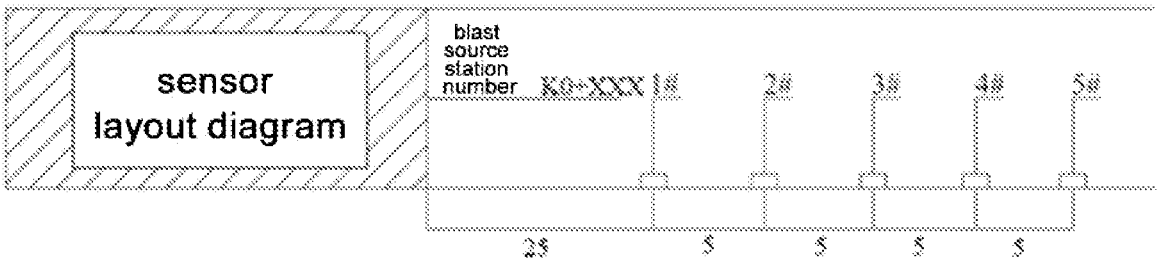
FIG. 5 is a diagram of sensor arrangement in a method for evaluating deep-buried tunnel blasting parameters according to an exemplary implementation.
Figure 6:
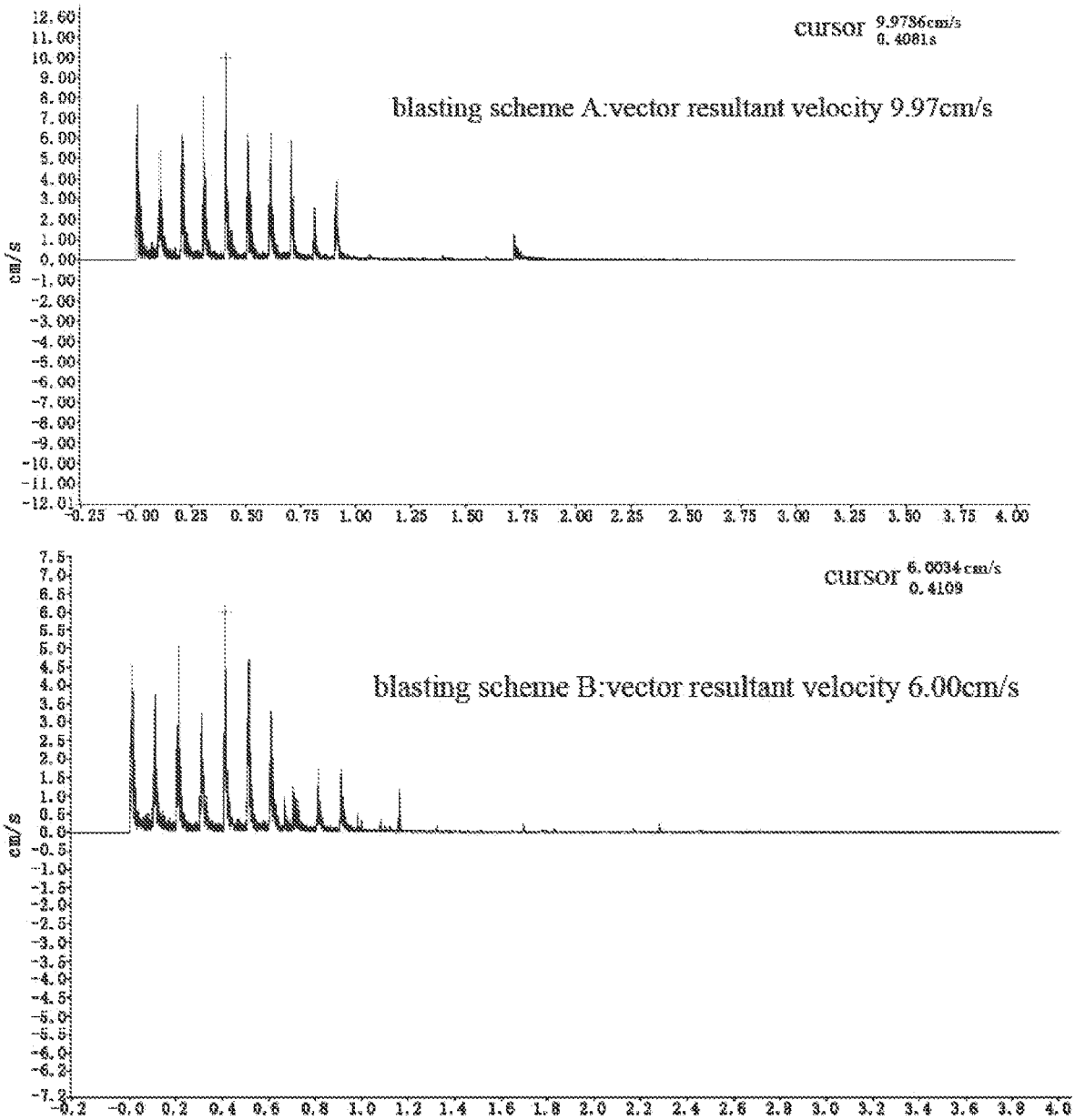
FIG. 6 is a comparison diagram of vector resultant velocities of a blasting scheme A and a blasting scheme B of a method for evaluating deep-buried tunnel blasting parameters according to an exemplary implementation.
Figure 7:
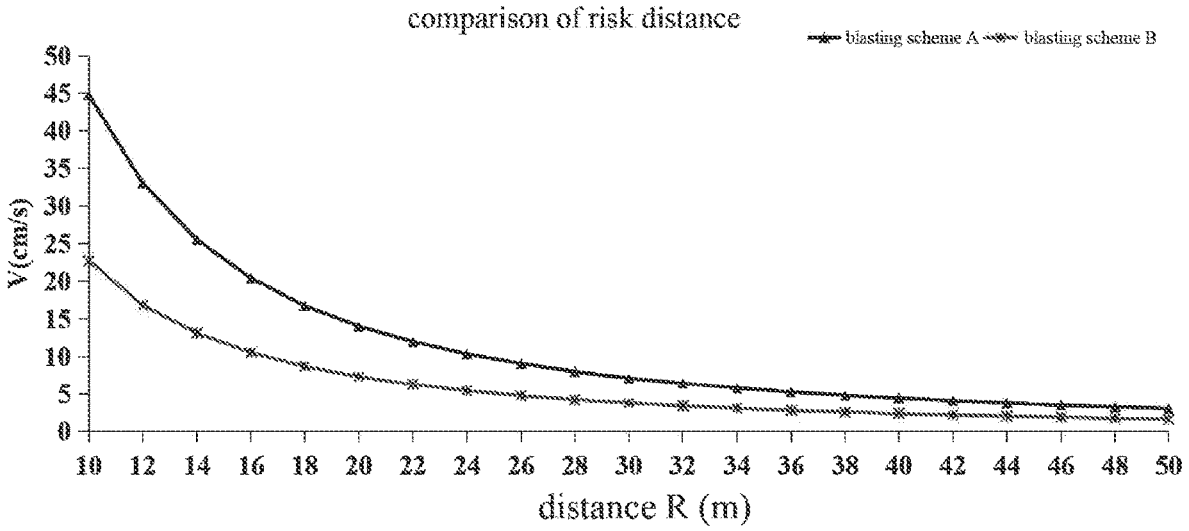
FIG. 7 is a comparison diagram of risk distances of a blasting scheme A and a blasting scheme B of a method for evaluating deep-buried tunnel blasting parameters according to an exemplary implementation.
Figure 10:
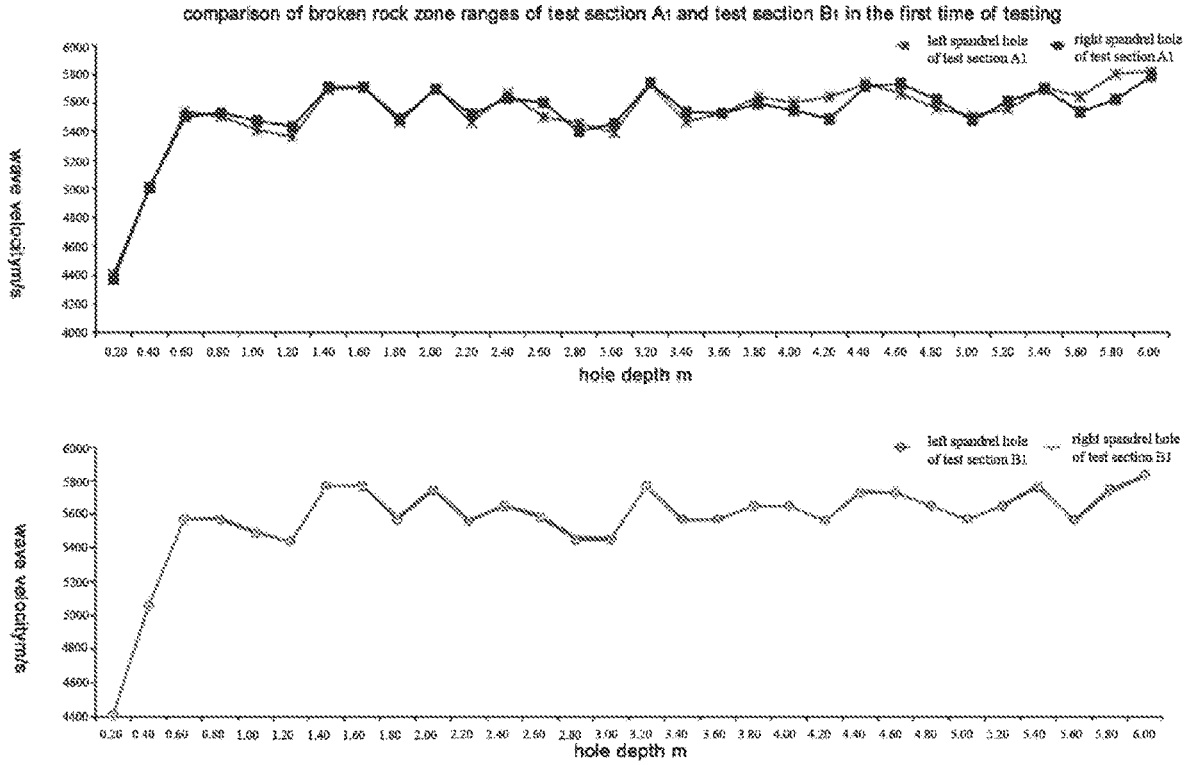
FIG. 10 is a comparison diagram of the first time of broken rock zone monitoring of a blasting scheme A and a blasting scheme B of a method for evaluating deep-buried tunnel blasting parameters according to an exemplary implementation.
Figure 11:
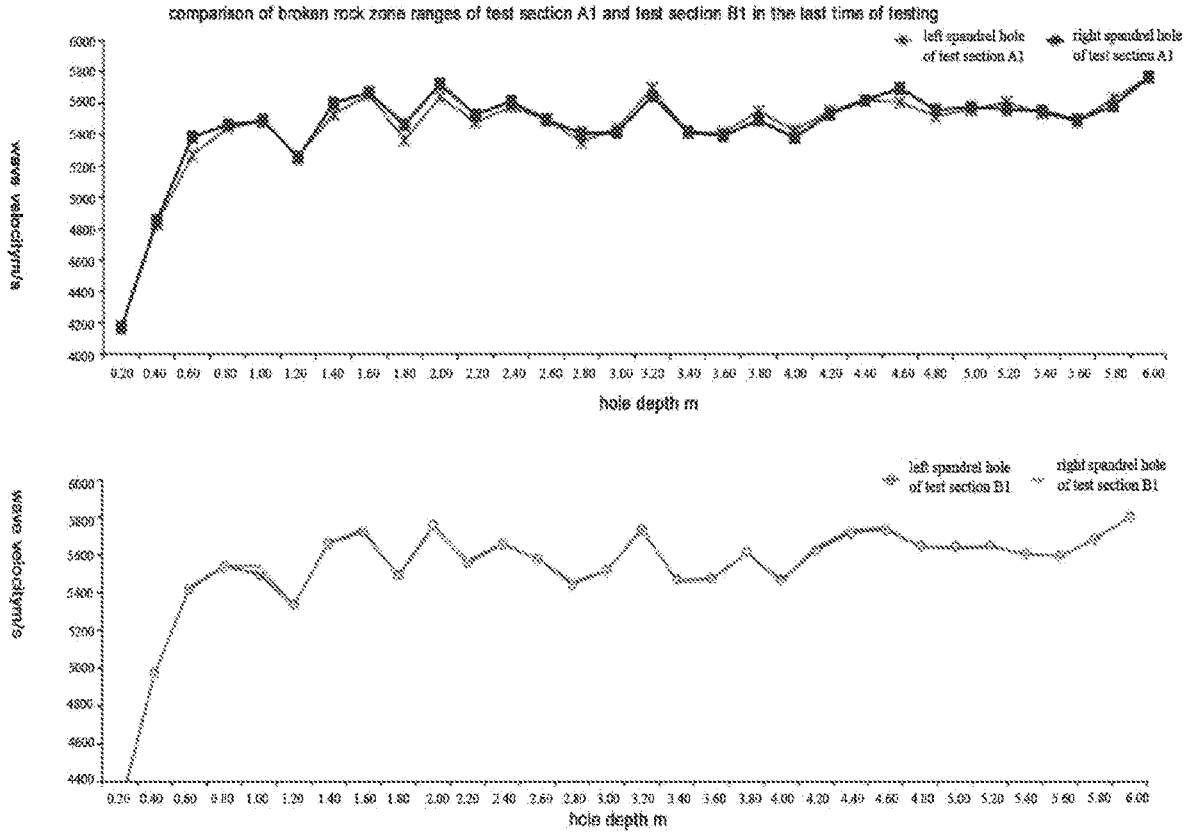
FIG. 11 is a comparison diagram of the last time of broken rock zone monitoring of a blasting scheme A and a blasting scheme B of a method for evaluating deep-buried tunnel blasting parameters according to an exemplary implementation.
Figure 13:
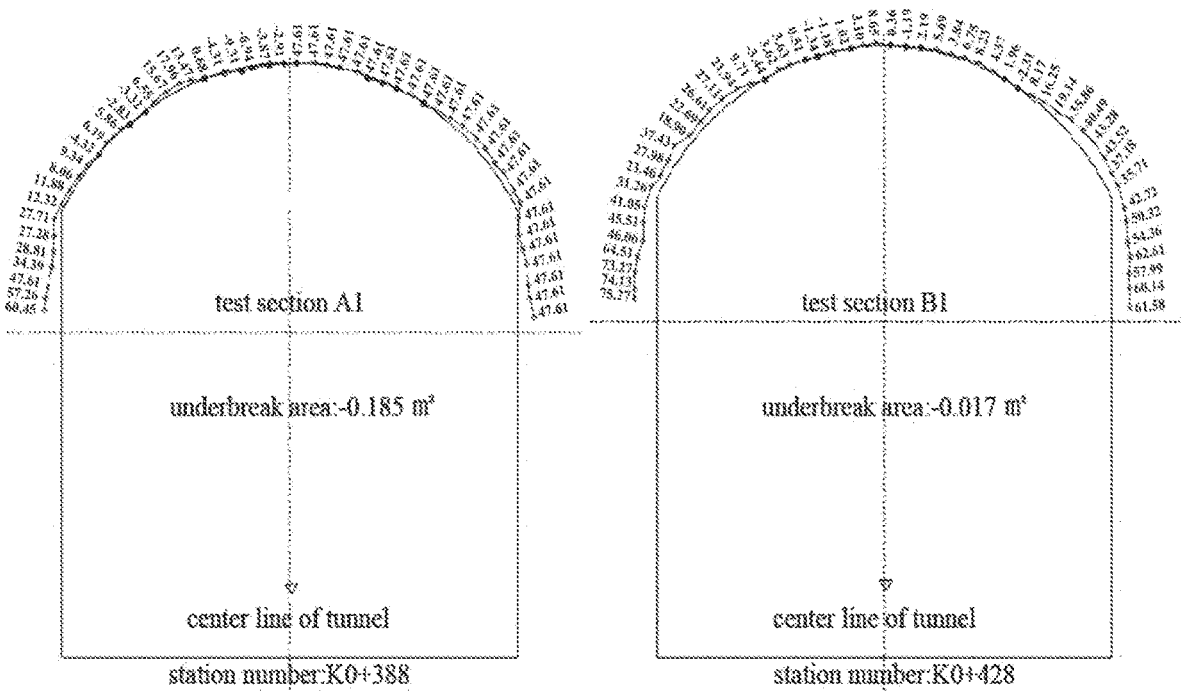
FIG. 13 is a comparison diagram of underbreak areas, at a starting point, of a test section $A_1$ and a test section $B_1$ in a method for evaluating deep-buried tunnel blasting parameters according to an exemplary implementation.
Figure 14:
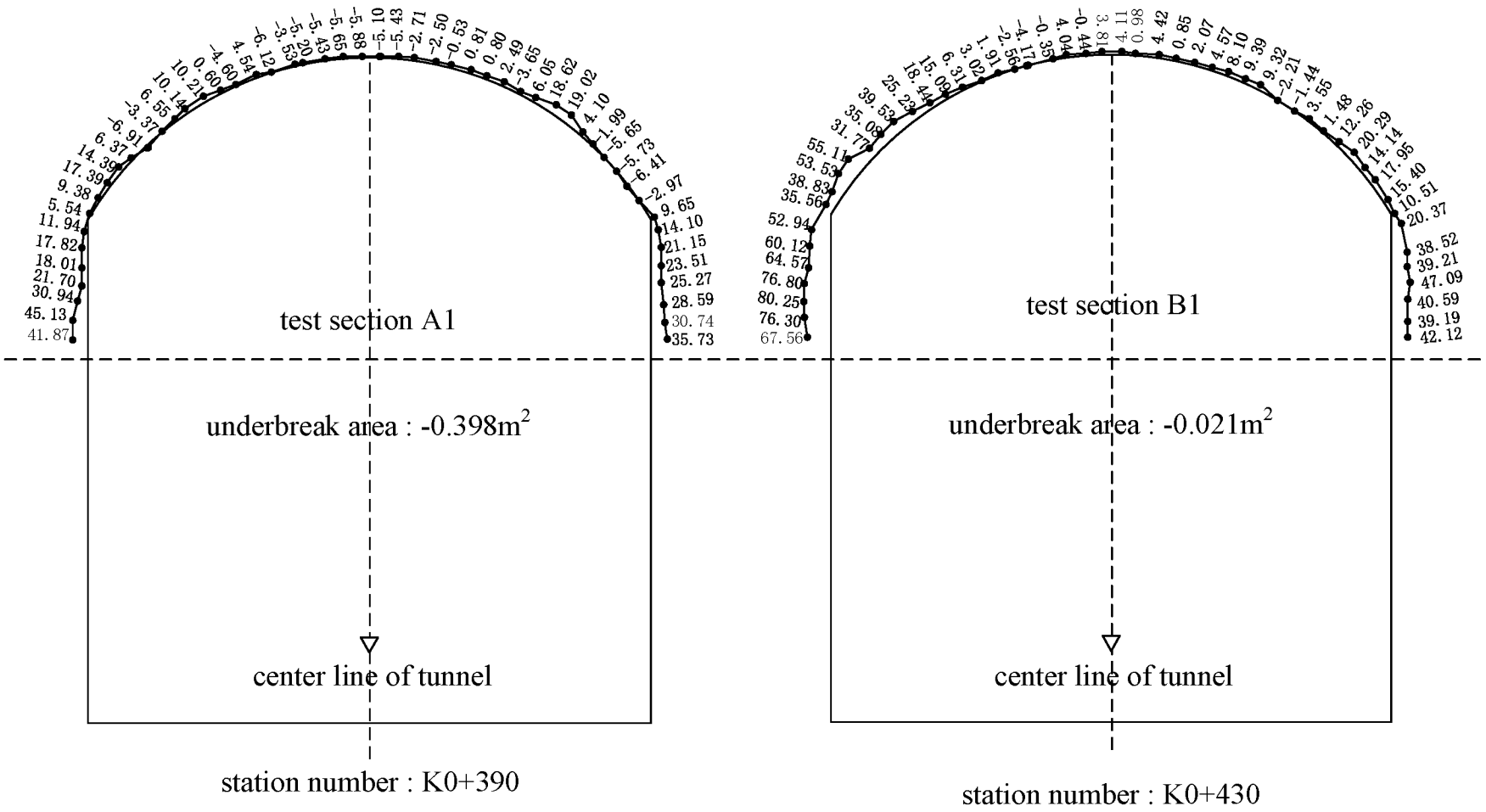
FIG. 14 is a comparison diagram of underbreak areas, at a position 2 m away from the starting point, of a test section $A_1$ and a test section $B_1$ in a method for evaluating deep-buried tunnel blasting parameters according to an exemplary implementation.
Figure 15:
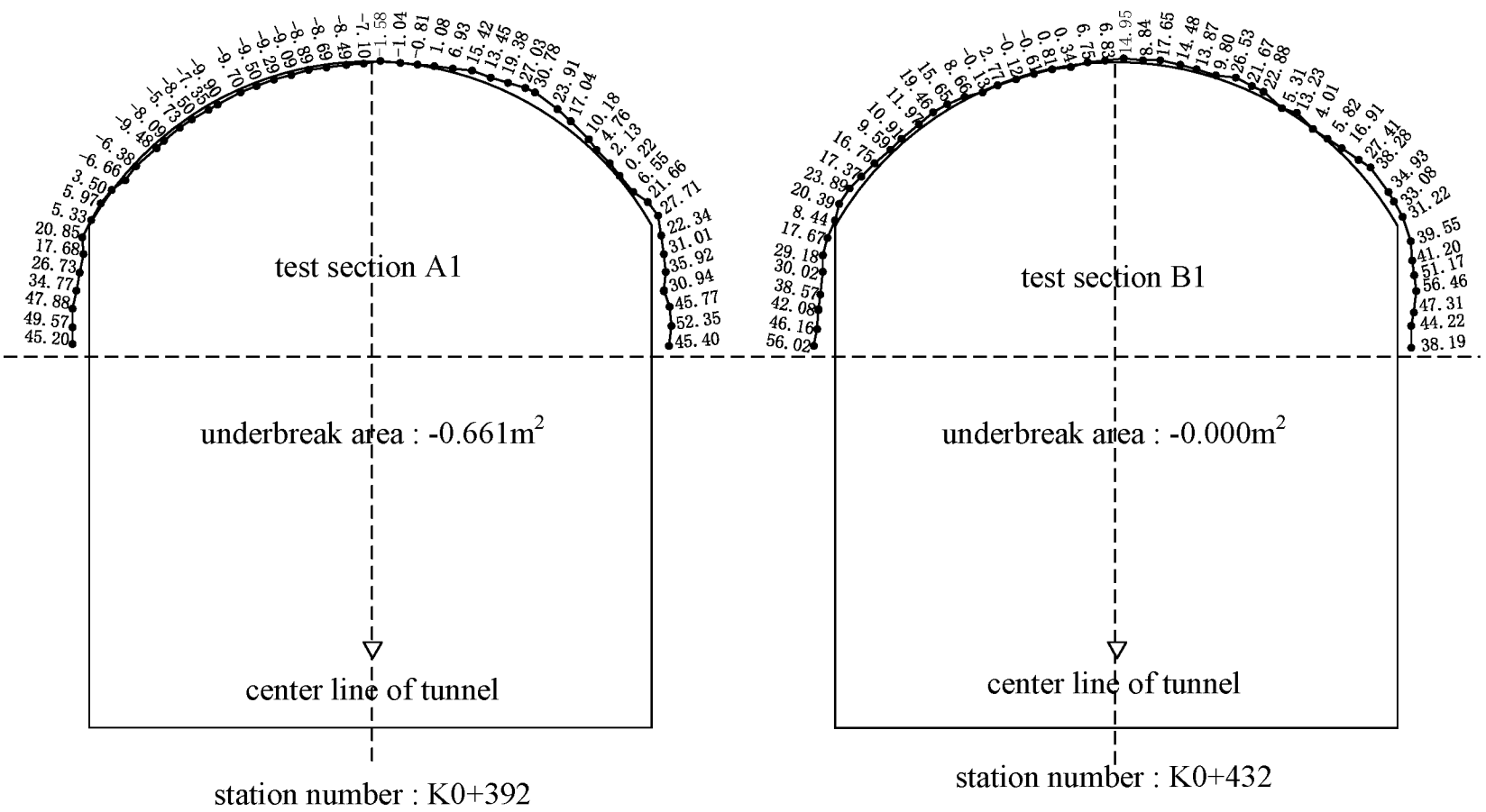
FIG. 15 is a comparison diagram of underbreak areas, at a position 4 m away from the starting point, of a test section $A_1$ and a test section $B_1$ in a method for evaluating deep-buried tunnel blasting parameters according to an exemplary implementation.
Figure 16:
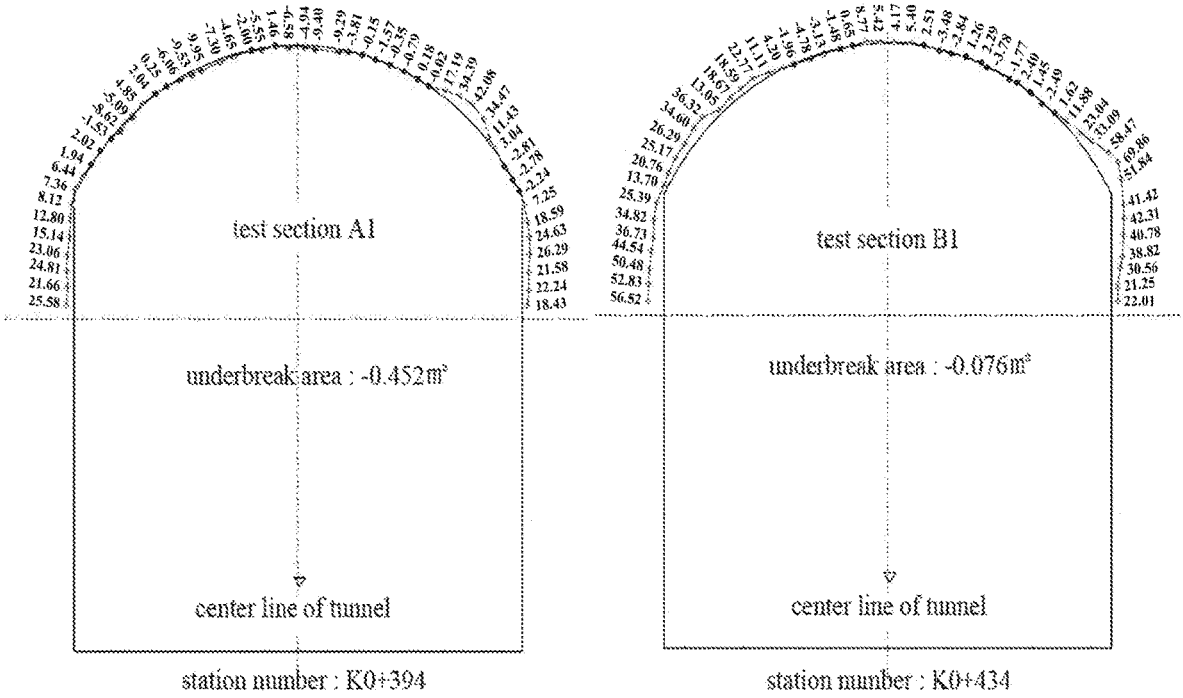
FIG. 16 is a comparison diagram of underbreak areas, at a position 6 m away from the starting point, of a test section $A_1$ and a test section $B_1$ in a method for evaluating deep-buried tunnel blasting parameters according to an exemplary implementation.
Figure 17:
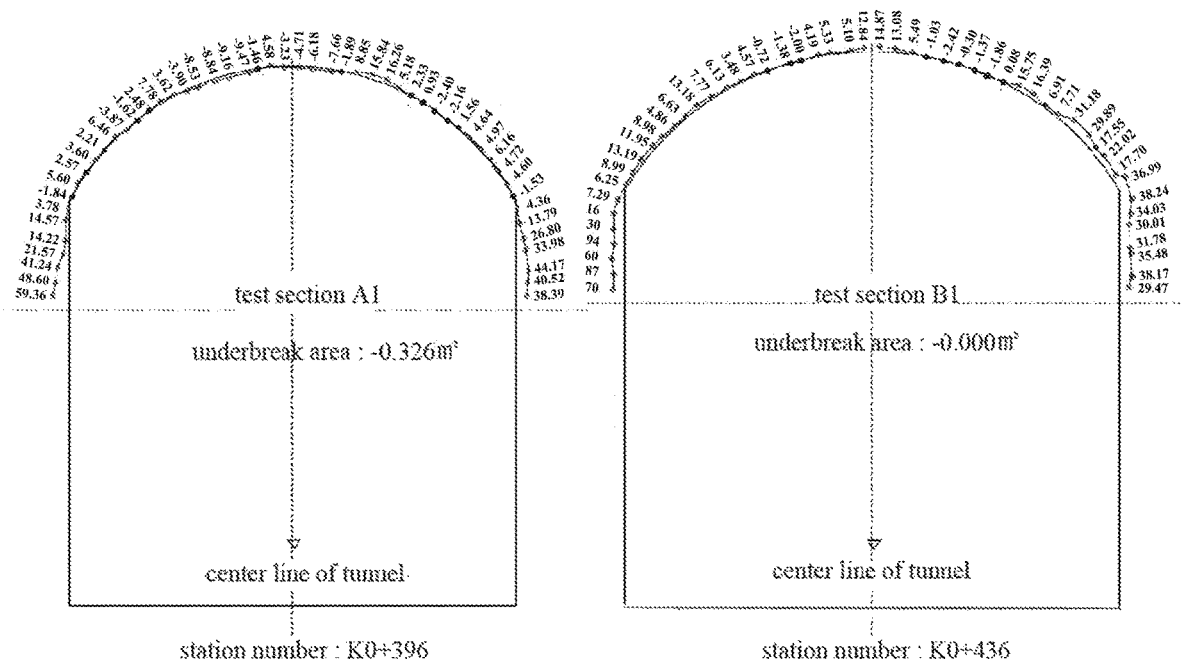
FIG. 17 is a comparison diagram of underbreak areas, at a position 8 m away from the starting point, of a test section $A_1$ and a test section $B_1$ in a method for evaluating deep-buried tunnel blasting parameters according to an exemplary implementation.
Figure 18:
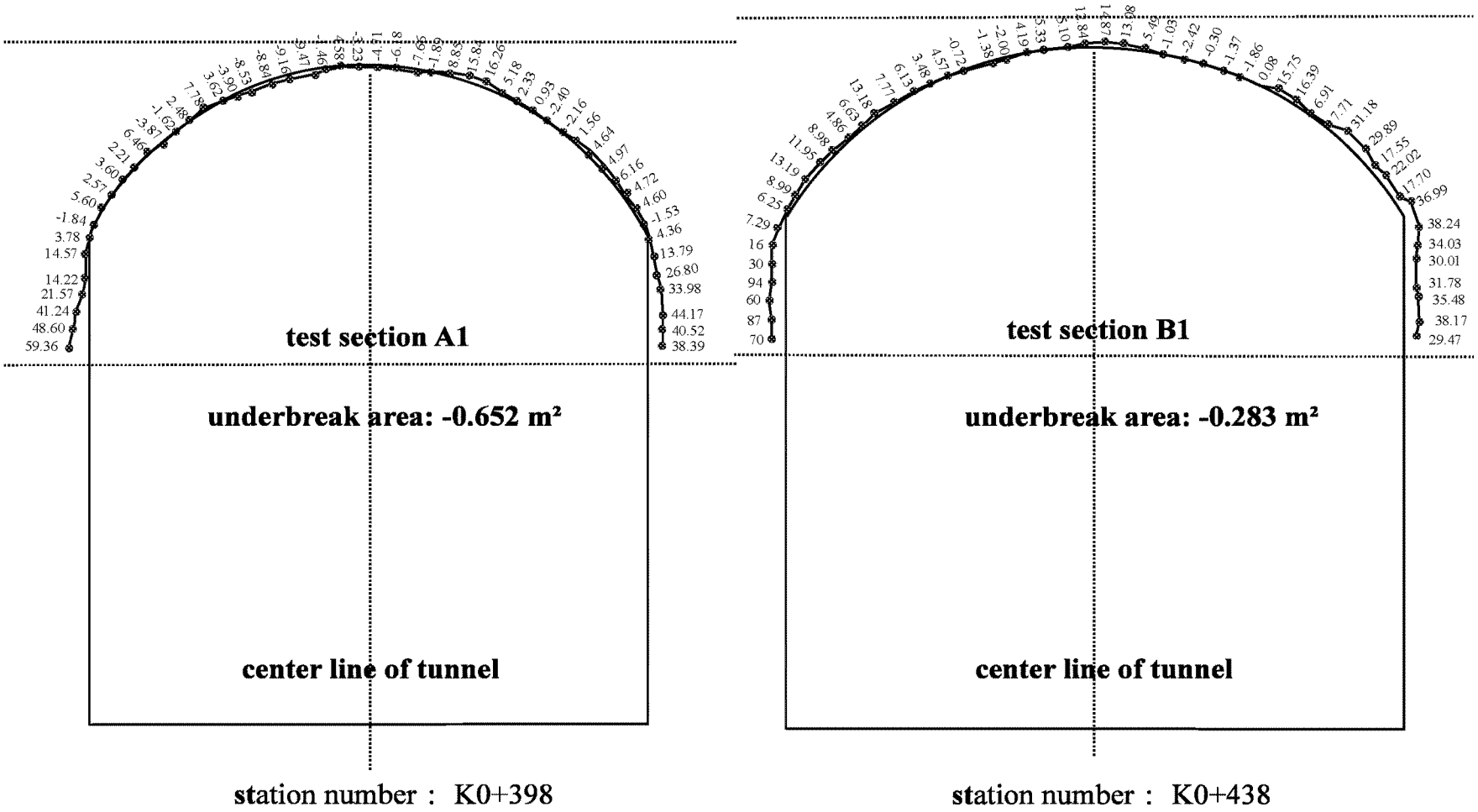
FIG. 18 is a comparison diagram of underbreak areas, at a position 10 m away from the starting point, of a test section $A_1$ and a test section $B_1$ in a method for evaluating deep-buried tunnel blasting parameters according to an exemplary implementation.

As shown in FIGS. 1-19, FIG. 1 is a flowchart of a method for evaluating deep-buried tunnel blasting parameters provided by the invention; FIG. 2 is a drilling diagram of a blasting scheme A of a method for evaluating deep-buried tunnel blasting parameters provided by the invention; FIG. 3 is drilling diagram of a blasting scheme B of a method for evaluating deep-buried tunnel blasting parameters provided by the invention; FIG. 4 is a vertical section view of geological conditions of a test section $A_1$ and a test section $B_1$ in a method for evaluating deep-buried tunnel blasting parameters provided by the invention; FIG. 5 is a diagram of sensor arrangement in a method for evaluating deep-buried tunnel blasting parameters provided by the invention; FIG. 6 is a comparison diagram of vector resultant velocities of a blasting scheme A and a blasting scheme B of a method for evaluating deep-buried tunnel blasting parameters provided by the invention; FIG. 7 is a comparison diagram of risk distances of a blasting scheme A and a blasting scheme B of a method for evaluating deep-buried tunnel blasting parameters provided by the invention; FIG. 8 is a comparison diagram of averaged and fitted blast vibration data of a blasting scheme A and a blasting scheme B of a method for evaluating deep-buried tunnel blasting parameters provided by the invention; FIG. 9 is a comparison diagram of unblasted hole rates of a blasting scheme A and a blasting scheme B of a method for evaluating deep-buried tunnel blasting parameters provided by the invention; FIG. 10 is a comparison diagram of the first time of broken rock zone monitoring of a blasting scheme A and a blasting scheme B of a method for evaluating deep-buried tunnel blasting parameters provided by the invention; FIG. 11 is a comparison diagram of the last time of broken rock zone monitoring of a blasting scheme A and a blasting scheme B of a method for evaluating deep-buried tunnel blasting parameters provided by the invention; FIG. 12 is a comparison diagram of average wave velocities of a blasting scheme A and a blasting scheme B of a method for evaluating deep-buried tunnel blasting parameters provided by the invention; FIG. 13 is a comparison diagram of underbreak areas, at a first same tunnel segment, of a test section $A_1$ and a test section $B_1$ in a method for evaluating deep-buried tunnel blasting parameters provided by the invention; FIG. 14 is a comparison diagram of underbreak areas, at a second same tunnel segment, of a test section $A_1$ and a test section $B_1$ in a method for evaluating deep-buried tunnel blasting parameters provided by the invention; FIG. 15 is a comparison diagram of underbreak areas, at a third same tunnel segment, of a test section $A_1$ and a test section $B_1$ in a method for evaluating deep-buried tunnel blasting parameters provided by the invention; FIG. 16 is a comparison diagram of underbreak areas, at a fourth same tunnel segment, of a test section $A_1$ and a test section $B_1$ in a method for evaluating deep-buried tunnel blasting parameters provided by the invention; FIG. 17 is a comparison diagram of underbreak areas, at a fifth same tunnel segment, of a test section $A_1$ and a test section $B_1$ in a method for evaluating deep-buried tunnel blasting parameters provided by the invention; FIG. 18 is a comparison diagram of underbreak areas, at a sixth same tunnel segment, of a test section $A_1$ and a test section $B_1$ in a method for evaluating deep-buried tunnel blasting parameters provided by the invention; and FIG. 19 is a comparison diagram of diversified monitoring data of a blasting scheme A and a blasting scheme B of a method for evaluating deep-buried tunnel blasting parameters provided by the invention.

A method for evaluating deep-buried tunnel blasting parameters according to an embodiment of the invention comprises: setting multiple diverse blasting schemes; selecting a plurality of test sections with the same geological characteristics, the number of the test sections corresponding to the number of the blasting schemes; blasting the test sections using the blasting schemes, and obtaining diversified monitoring data of each test section; and comparing the diversified monitoring data to select the optimal blasting schemes for the test sections.

As shown in FIG. 1, in the first step, two different blasting schemes A and B are set, and the differences are mainly in individual-hole charge, total charge, blasthole arrangement, blasthole number, blasting accessories, and initiation mode; and in the second step, two test sections $A_1$ and $B_1$ are selected, which have the same geological characteristics such as surrounding rock lithology and grade, allowing for more accurate determination of the suitability of the blasting schemes A and B for the test sections $A_1$ and $B_1$. First, drilling is conducted on a fracture surface of the test section $A_1$, with the drilling position determined by the blasthole number and blasthole arrangement in the blasting scheme A; and then, according to the individual-hole charge in the blasting scheme A, explosive is put in the holes for blasting, and testing is conducted during or after blasting, so as to obtain the diversified monitoring data of the test section $A_1$. A fracture surface after blasting is usually not vertical to the ground. A preliminary survey is conducted on a fracture surface formed after advancing several meters after blasting. When the fracture surface is suitable for drilling or installation of blasting control points, blasting is conducted according to the blasthole number and blasthole arrangement in the blasting scheme A. In this way, circular operation is conducted on the test section $A_1$ until it is fully blasted. Similarly, blasting is conducted on the test section $B_1$ using the blasting scheme B, and the diversified monitoring data during or after blasting are collected. Finally, the collected diversified monitoring data are analyzed and compared. The diversified monitoring data are obtained by multipoint displacement meter monitoring, anchor stress gauge monitoring, geological radar prediction, blast vibration monitoring, microseismic monitoring, broken rock zone monitoring, three-dimensional laser scanning and other diversified monitoring means. These data are used for selecting the optimal blasting schemes for the test sections $A_1$ and $B_1$, thus providing technical guidance for safe construction of underground chambers, and promoting innovation and development in underground construction technology.

In a preferred embodiment of the invention, the blasting scheme comprises individual-hole charge, total charge, blasthole arrangement, blasthole number and initiation mode. The individual holes comprise cut holes, breaking holes, bottom holes and peripheral holes.

As shown in FIGS. 2 and 3, the blasting design parameters of the blasting scheme A are as follows: the total number of blastholes is 200; the cut holes comprise 20 inner cut holes and 14 outer cut holes, with the inner cut holes located at a center of a heading face and arranged into a diamond or other shapes, and the outer cut holes arranged in parallel in two columns at two sides of the inner cut slots in the heading face at the same height, and the individual-hole charge of the inner cut holes and the outer cut holes is 2.4 kg; there are 80 breaking holes which are located on the heading face and surround the cut holes, and the individual-hole charge of the breaking holes is 2.1 kg; there are 60 peripheral holes which are located on the periphery of the heading face, and the individual-hole charge of the peripheral holes is 0.3-0.6 kg; there are 18 bottom holes which are located near the ground, and the individual-hole charge of the bottom holes is 2.4 kg; and unit explosive consumption is 0.71. The blasting design parameters of the blasting scheme B are as follows: the total number of blast holes is 200, and the positions of the cut holes, the breaking holes, the bottom holes and the peripheral holes can be basically the same as those of the blasting scheme A; however, the individual-hole charge of the inner cut holes and the outer cut holes is 2.1 kg, the individual-hole charge of the breaking holes is 1.8 kg, the individual-hole charge of the bottom holes is 1.8 kg, the individual-hole charge of the peripheral holes is 0.45-0.6 kg, and unit explosive consumption is 0.63. In addition, millisecond blasting is adopted by both the blasting scheme A and the blasting scheme B; in the blasting scheme A, the whole test section $A_1$ is divided into 10 segments for initiation, with a millisecond blasting delay of 100 ms; and in the blasting scheme B, the whole test section $B_1$ is divided into 10 segments for initiation, with a millisecond blasting delay of 100 ms.

In a preferred embodiment of the present invention, the length of the test section is 20-50 m, and when at least two consecutive test sections form a whole, the diversified monitoring data are obtained from a first section of each test section.

As shown in FIG. 4, since it is difficult to find similar geological characteristics such as lithology and grade in surrounding rocks that are not in the same geographical location, continuous test section $A_1$ and test section $B_1$ can be set in the same geographical location, each of which comprises a head section, a middle section and a tail section, and the tail section of the test section $A_1$ is connected with the head section of the test section $B_1$, resulting in similar geological characteristics such as surrounding rock lithology and grade in the test sections $A_1$ and $B_1$. The test sections $A_1$ and $B_1$ are each set to a length of 20-50 m. To avoid mutual interference with monitoring data between the test sections $A_1$ and $B_1$ during blasting, it is preferred to set up a key monitoring section $A_1'$ in the front of the test section $A_1$, and a key monitoring section $B_1'$ in the front of the test section $B_1$. For example, if the station number for the test section $A_1$ is from $K_0$+380 to $K_0$+430, then the station number for the key monitoring section $A_1'$ would be from $K_0$+380 to $K_0$+390. If the station number for the test section $B_1$ is from $K_0$+430 to $K_0$+470, then the station number for the key monitoring section $B_1'$ would be from $K_0$+430 to $K_0$+440. This allows for blasting in the first 10 m of the test section, followed by installation of an acoustic wave tester for broken rock zone monitoring in a tunnel segment after the first 10 m. In a preferred embodiment of the invention, obtaining diversified monitoring data of at least two test sections comprises: conducting blast vibration monitoring, broken rock zone monitoring, and three-dimensional laser scanning on the test sections; calculating a vector resultant velocity and a risk distance based on vibration monitoring data obtained from blast vibration monitoring; calculating an unblasted hole rate; calculating a rock wave velocity and a broken rock zone thickness based on acoustic wave test results of broken rock zone monitoring; and obtaining overbreak and underbreak situations of typical fracture surfaces based on 3D point cloud data obtained from three-dimensional laser scanning.

As shown in FIGS. 1-19, based on the vibration monitoring data of each monitoring point, the vector resultant velocity and risk distance of each monitoring point under the blasting scheme A and the blasting scheme B can be obtained. The smaller the vector resultant velocity and risk distance, the smaller the disturbance to the excavated chamber. Therefore, which blasting scheme, A or B, is more favorable can be determined from the perspective of blast vibration monitoring. Additionally, based on the acoustic wave test results, the rock wave velocity and the broken rock zone thickness under the blasting scheme A and the blasting scheme B can be obtained. The larger the rock wave velocity and the smaller the broken rock zone thickness, the less the impact on rock mass quality. Therefore, which blasting scheme, A or B, has a greater impact on rock mass quality is determined. Lastly, the overbreak and underbreak situations of typical fracture surfaces under the blasting scheme A and the blasting scheme B can be obtained based on the 3D point cloud data, such as the underbreak area and quantity of the typical fracture surfaces. The blasting scheme with smaller underbreak area and quantity demonstrates better excavation quality.

The underbreak area of a typical fracture surface is shown in FIG. 13. The position of the station number $K_0$+388 in the test section $A_1$ is equivalent to the position of the station number $K_0$+428 in the test section $B_1$. Based on the 3D point cloud data, the underbreak area at the station number $K_0$+388 is −0.185 $m^2$, and the underbreak area at the station number $K_0$+428 is −0.017 $m^2$. Therefore, the blasting scheme B is preferable for this fracture surface. For other fracture surfaces, as shown in FIGS. 14-18, the blasting scheme B is also more favorable.

In a preferred embodiment of the invention, calculating a vector resultant velocity and a risk distance based on vibration monitoring data obtained from blast vibration monitoring comprises: setting a safety allowable vibration velocity $v_0$; obtaining a terrain condition coefficient K and a geological condition coefficient α; and substituting the safety allowable vibration velocity $v_0$ into the Sadaovsk formula $$R_0 = \left(\frac{K}{V_0}\right)^{\frac{1}{\alpha}} \cdot Q^{\frac{1}{3}}$$

to obtain a risk distance $R_0$, where Q is the total charge of simultaneous blasting or the maximum individual-stage charge of delayed blasting. The safety allowable vibration velocity $v_0$ is set according to the blast vibration safety allowable standard and protected objects, for example, $v_0$ is set to 15 m/s for a hydraulic tunnel. The terrain condition coefficient K and the geological condition coefficient α are usually obtained based on field test data. In the absence of field test data, they can be selected according to the classification of rock as shown in Table 1. By substituting $v_0$, K, and α into the Sadaovsk formula $$R_0 = \left(\frac{K}{V_0}\right)^{\frac{1}{\alpha}} \cdot Q^{\frac{1}{3}},$$

and applying the maximum individual-stage charge in the blasting scheme A and the blasting scheme B, the risk distance $R_0$ for the blasting scheme A and the blasting scheme B can be determined and then compared.

TABLE 1

K and α values for different rock types in blasting area

| Rock type | K | α |
|---|---|---|
| Hard rock | 50~150 | 1.3~1.5 |
| Medium hard rock | 150~250 | 1.5~1.8 |
| Soft rock | 250~350 | 1.8~2.0 |

In a preferred embodiment of the invention, obtaining a terrain condition coefficient K and a geological condition coefficient α comprises: selecting a first monitoring point in the test section, installing a first sensor to monitor particle vibration velocities $v_{x1}$, $v_{y1}$, and $v_{z1}$ of the first monitoring point in x, y and z directions, and calculating a vector resultant velocity $v_1$ of the first monitoring point; measuring a distance $R_1$ from the first monitoring point to a heading face; selecting a second monitoring point in the test section, installing a second sensor to monitor particle vibration velocities $v_{x2}$, $v_{y2}$, and $v_{z2}$ of the second monitoring point in x, y and z directions, and calculating the vector resultant velocity $v_2$ of the second monitoring point; measuring a distance $R_2$ from the second monitoring point to the heading face; and substituting $v_1$ and $R_1$ into the Sadaovsk formula $$R_1 = \left(\frac{K}{V_1}\right)^{\frac{1}{\alpha}} \cdot Q^{\frac{1}{3}},$$

and substituting $v_2$ and $R_2$ into the Sadaovsk formula $$R_2 = \left(\frac{K}{V_2}\right)^{\frac{1}{\alpha}} \cdot Q^{\frac{1}{3}}$$

to form an equation set, so as to obtain the terrain condition coefficient K and the geological condition coefficient α.

As shown in FIGS. 6-8, with regard to the blasting scheme, the first sensor arranged at the first monitoring point typically measures the particle vibration velocities of the first monitoring point in the x, y, and z directions, enabling calculation of the vector resultant velocity $v_1$ of the first monitoring point. Moreover, the distance $R_1$ from the first monitoring point to the heading face is measured. Similarly, the vector resultant velocity $v_2$ of the second monitoring point, and the distance $R_2$ from the second monitoring point to the heading surface can be obtained. For the blasting scheme A, with the blasting charge Q as a definite value, the values of the terrain condition coefficient K and the geological condition coefficient α can be determined. Similarly, the values of the terrain condition coefficient K and the geological condition coefficient α for the blasting scheme B can be obtained.

In a preferred embodiment of the invention, there are five sensors, and the five sensors are sequentially arranged 25 m, 30 m, 35 m, 40 m and 45 m away from the heading face, so as to fit two curves according to the Sadaovsk formula to obtain the terrain condition coefficient K and the geological condition coefficient α.

As shown in FIG. 5, the particle vibration velocity of each monitoring point can be recorded and calculated using sensors placed at positions 25 m, 30 m, 35 m, 40 m and 45 m away from the heading face corresponding to the monitoring points respectively, enabling the fitting of two curves using the Sadaovsk formula, so that the terrain condition coefficient K and the geological condition coefficient α for the blasting scheme A can be obtained, and the terrain condition coefficient K and the geological condition coefficient α for the blasting scheme B can be obtained.

In a preferred embodiment of the invention, calculating a rock wave velocity and a broken rock zone thickness based on acoustic wave test results of broken rock zone monitoring comprises: conducting rock wall drilling and water injection to provide a coupling agent needed for testing; sending a probe of an acoustic wave tester to a bottom of a hole, the probe comprising a transmitter and two receivers; adjusting parameters of the acoustic wave tester; continuously injecting water into the hole, and moving the probe along an axis of the hole according to a predetermined sampling interval to collect data separately, so as to obtain rock wave velocities at different depths from a surrounding rock wall; and plotting a depth-wave velocity curve according to the rock wave velocities, and obtaining the broken rock zone thickness.

As shown in FIGS. 10-12, the acoustic wave method is based on the propagation of acoustic waves in rock mass. When there are developed fractures and decreased density in the rock mass, the acoustic impedance increases and the wave velocity decreases, and vice versa. Therefore, high acoustic wave velocities indicate good integrity of surrounding rock, while low wave velocities indicate the presence of fractures and poor integrity. In the acoustic testing process, drilling is conducted perpendicular to a surrounding rock wall, and water is continuously injected into the hole as a coupling agent for testing. A probe of an acoustic wave tester, which comprises a transmitter and two receivers, is sent to the bottom of the hole. The transmitter and the two receivers are arranged with a spacing in between, resulting in a time difference between the reception of signals by the two receivers from the transmitter. The information about the time difference and wave amplitude is then transmitted to a main unit of the acoustic wave tester for analysis. During the test, the probe moves outward from the bottom of the hole in a predetermined direction by a certain distance, enabling the acquisition of wave velocity values at various positions within the hole. Then a depth-wave velocity curve is plotted to determine the broken rock zone thickness.

In a preferred embodiment of the invention, comparing the diversified monitoring data to select the optimal blasting schemes for the test sections comprises: comparing vector resultant velocities of at least two blasting schemes and selecting a blasting scheme with a smaller vector resultant velocity; comparing risk distances of at least two blasting schemes and selecting a blasting scheme with a smaller risk distance; comparing unblasted hole rates of at least two blasting schemes and selecting a blasting scheme with a larger unblasted hole rate; comparing broken rock zone thicknesses of at least two blasting schemes, and selecting a blasting scheme with a smaller broken rock zone thickness; comparing overbreak and underbreak situations of at least two blasting schemes, and selecting a blasting scheme with less overbreak and underbreak; and conducting comprehensive evaluation on the selected blasting schemes to determine the optimal blasting schemes for the test sections.

As shown in FIG. 19, the vector resultant velocity of the blasting scheme A is 9.97 cm/s, and that of the blasting scheme B is 6 cm/s, so the blasting scheme B is selected. The risk distance of the blasting scheme A is 17.82 m, and that of the blasting scheme B is 14.82 m, so the blasting scheme B is selected. The average unblasted hole rate of the blasting scheme A is 78.61%, and that of the blasting scheme B is 84.84%, so the blasting scheme B is selected.

According to the method for evaluating the deep-buried tunnel blasting parameters, blasting evaluation indexes are obtained through blast vibration monitoring, excavation face characteristics and 3D point cloud data fields are obtained through three-dimensional laser scanning, damage information of shallow and deep layers on a free face of a chamber is obtained through broken rock zone monitoring, and based on these core information, the quality of blasting excavation of deep-buried tunnels under different blasting schemes and the influence on an excavated chamber are evaluated from multiple dimensions, allowing for the selection of the optimal blasting schemes, and providing a new approach for evaluating various blasting schemes, thereby ensuring the safety and quality of blasting excavation of deep-buried tunnels.

In the embodiments of the invention, the term "a plurality of" refers to two or more, unless otherwise specified and limited. The terms "installation", "connection" and "fixation" should be understood in a broad sense, for example, "connection" may be fixed connection, detachable connection, or integrated connection. For those of ordinary skill in the art, the specific meanings of the above terms in the embodiments of invention may be understood according to specific situations.

In the description of the embodiments of the invention, it should be understood that orientation or positional relationships indicated by terms such as "up" and "down" are based on the orientation or positional relationships shown in the accompanying drawings, and are to facilitate the description of the embodiments of the invention and simplify the description only, rather than indicating or implying that the device or element referred to must have a specific orientation or be constructed and operated in a specific orientation, and therefore cannot be construed as limiting the embodiments of the invention.

In the description of this specification, terms such as "an embodiment" and "a preferred embodiment" indicate that the specific features, structures, materials, or characteristics described in conjunction with that embodiment or example are included in at least one embodiment or example of the invention. In this specification, the indicative statements regarding the above-mentioned terms do not necessarily refer to the same embodiment or example. Moreover, the specific features, structures, materials, or characteristics described can be combined in a suitable manner in any one or more embodiments or examples.

The above are merely preferred embodiments of the invention, and should not be used to limit the invention. For those skilled in the art, various modifications and changes can be made to the embodiments of the invention. Any modifications, substitutions, improvements, etc. made within the spirit and principles of the embodiments of the invention should be included within the scope of protection of the embodiments of the invention.

The invention claimed is:

1. A method for evaluating deep-buried tunnel blasting parameters, comprising:

setting at least two different blasting schemes;

selecting at least two test sections with same geological characteristics, the at least two different blasting schemes corresponding to the at least two test sections, respectively, and a number of the at least two test sections corresponding to a number of the at least two different blasting schemes;

blasting the at least two test sections using the at least two different blasting schemes, respectively, and obtaining various monitoring data of each of the at least two test sections, wherein the various monitoring data include a vector resultant velocity and a risk distance, an unblasted hole rate, a rock wave velocity and a broken rock zone thickness, overbreak and underbreak situations of typical fracture surfaces of the each of the at least two test sections; and comparing the obtained various monitoring data among the at least two test sections to select an optimal blasting schemes for the at least two test sections;

wherein the obtaining various monitoring data of each of the at least two test sections comprises:

conducting blast vibration monitoring, broken rock zone monitoring, and three-dimensional laser scanning on the at least two test sections;

calculating the vector resultant velocity and the risk distance based on vibration monitoring data obtained from the blast vibration monitoring;

calculating the unblasted hole rate;

calculating the rock wave velocity and the broken rock zone thickness based on acoustic wave test results of broken rock zone monitoring; and obtaining the overbreak and underbreak situations of typical fracture surfaces based on 3D point cloud data obtained from the three-dimensional laser scanning.

2. The method for evaluating the deep-buried tunnel blasting parameters according to claim 1, wherein each of the at least two different blasting schemes comprises an individual-hole charge of each of blastholes of the at least two test sections, a total charge of the blastholes, a blasthole arrangement of the blastholes, a number of the blastholes, and an initiation mode.

3. The method for evaluating the deep-buried tunnel blasting parameters according to claim 2, wherein the blastholes comprise cut holes, breaking holes, bottom holes and peripheral holes.

4. The method for evaluating the deep-buried tunnel blasting parameters according to claim 1, wherein the length of each of the at least two test sections is 20-50 m.

5. The method for evaluating the deep-buried tunnel blasting parameters according to claim 1, wherein calculating the vector resultant velocity and the risk distance based on vibration monitoring data obtained from blast vibration monitoring comprises:

setting a safety allowable vibration velocity $v_0$;

obtaining a terrain condition coefficient K and a geological condition coefficient $\alpha$; and substituting the safety allowable vibration velocity $v_0$ into the Sadaovsk formula $$R_0 = \left(\frac{K}{V_0}\right)^{\frac{1}{\alpha}} \cdot Q^{\frac{1}{3}}$$

to obtain a risk distance $R_0$, where Q is the total charge of simultaneous blasting or the maximum individual-stage charge of delayed blasting.

6. The method for evaluating the deep-buried tunnel blasting parameters according to claim 5, wherein obtaining the terrain condition coefficient K and the geological condition coefficient $\alpha$ comprises:

selecting a first monitoring point in the each of the two test sections, installing a first sensor to monitor particle vibration velocities $v_{x1}$, $v_{y1}$, and $v_{z1}$ of the first monitoring point in x, y and z directions, and calculating a vector resultant velocity $v_1$ of the first monitoring point;

measuring a distance $R_1$ from the first monitoring point to a heading face;

selecting a second monitoring point in the each of the two test sections, installing a second sensor to monitor particle vibration velocities $v_{x2}$, $v_{y2}$, and $v_{z2}$ of the second monitoring point in x, y and z directions, and calculating the vector resultant velocity $v_2$ of the second monitoring point;

measuring a distance $R_2$ from the second monitoring point to the heading face; and substituting $v_1$ and $R_1$ into the Sadaovsk formula $$R_1 = \left(\frac{K}{V_1}\right)^{\frac{1}{\alpha}} \cdot Q^{\frac{1}{3}},$$

and substituting $v_2$ and $R_2$ into the Sadaovsk formula $$R_2 = \left(\frac{K}{V_2}\right)^{\frac{1}{\alpha}} \cdot Q^{\frac{1}{3}}$$

to form an equation set, so as to obtain the terrain condition coefficient K and the geological condition coefficient $\alpha$.

7. The method for evaluating the deep-buried tunnel blasting parameters according to claim 6, wherein there are five sensors, and the five sensors are sequentially arranged 25 m, 30 m, 35 m, 40 m, and 45 m away from the heading face, so as to fit two curves according to the Sadaovsk formula to obtain the terrain condition coefficient K and the geological condition coefficient $\alpha$.

8. The method for evaluating the deep-buried tunnel blasting parameters according to claim 1, wherein calculating the rock wave velocity and the broken rock zone thickness based on acoustic wave test results of broken rock zone monitoring comprises:

conducting rock wall drilling and water injection to provide a coupling agent needed for testing;

sending a probe of an acoustic wave tester to a bottom of a blasthole, the probe comprising a transmitter and two receivers;

adjusting parameters of the acoustic wave tester;

continuously injecting water into the blasthole, and moving the probe along an axis of the blasthole according to a predetermined sampling interval to collect data separately, so as to obtain rock wave velocities at different depths from a surrounding rock wall; and plotting a depth-wave velocity curve according to the rock wave velocities, and obtaining the broken rock zone thickness.

9. The method for evaluating the deep-buried tunnel blasting parameters according to claim 1, wherein comparing the obtained various monitoring data to select the optimal blasting schemes for the at least two test sections comprises:

comparing vector resultant velocities of the at least two different blasting schemes and selecting a blasting scheme with a smaller vector resultant velocity;

comparing risk distances of the at least two different blasting schemes and selecting a blasting scheme with a smaller risk distance;

comparing unblasted hole rates of the at least two different blasting schemes and selecting a blasting scheme with a larger unblasted hole rate;

comparing broken rock zone thicknesses of the at least two different blasting schemes, and selecting a blasting scheme with a smaller broken rock zone thickness;

comparing overbreak and underbreak situations of the at least two different blasting schemes, and selecting a blasting scheme with less overbreak and underbreak; and conducting comprehensive evaluation on the selected blasting schemes to determine the optimal blasting schemes for the at least two test sections.

* * * * *